United States Patent [19]

Steddum

[11] 3,982,492

[45] Sept. 28, 1976

[54] FLOATING STRUCTURE

[75] Inventor: Riddle E. Steddum, Houston, Tex.

[73] Assignee: The Offshore Company, Houston, Tex.

[22] Filed: Apr. 25, 1975

[21] Appl. No.: 571,714

[52] U.S. Cl. ..... 114/.5 D; 61/98

[51] Int. Cl.[2] ..... B63B 35/44

[58] Field of Search ..... 114/.5 F, .5 D, 206 R, 114/230; 61/46.5; 9/8 P

[56] References Cited

UNITED STATES PATENTS

| | | | |
|---|---|---|---|
| 3,648,638 | 3/1972 | Blenkarn | 114/.5 D |
| 3,780,685 | 4/1971 | Horton | 114/.5 D |

*Primary Examiner*—Stephen G. Kunin
*Assistant Examiner*—Sherman D. Basinger
*Attorney, Agent, or Firm*—Vinson, Elkins, Searls, Connally & Smith

[57] ABSTRACT

An improved floating structure suitable for use as a floating drilling platform, production platform or other moored floating structure having a vertical tension mooring system with a plurality of anchors, ballasting and deballasting means, and a plurality of mooring lines connecting each anchor to the floating platform, the anchors having a total buoyancy to support the entire weight of the structure so that in transit a minimum structure is below the water, and to minimize surge or sway having a mooring line pretension to displacement ratio in the range from 0.05 to 0.3, having an anchor weight in the range from 0.10 to 0.45 of the anchor displacement and 0.10 to 0.60 of the platform displacement and an anchor displacement in the range from 1.05 to 1.30 times the platform displacement.

6 Claims, 5 Drawing Figures

THE EFFECT OF WATER DEPTH AND PRETENSION ON SURGE AMPLIFICATION FOR VERTICALLY MOORED PLATFORMS.

FLOATING STRUCTURE

BACKGROUND OF THE PRESENT INVENTION

In the past a mooring system for a floating platform which relies on the tension in a plurality of connections from the floating platform to an anchor on the bottom has been suggested by the R. P. Knapp U.S. Pat. No. 3,154,039, the K. A. Blenkarn U.S. Pat. No. 3,648,638 and the E. E. Horton U.S. Pat. No. 3,780,685.

SUMMARY

The present invention relates to an improved vertical tension mooring system for a floating structure, the basic components of which are disclosed in the co-pending application Ser. No. 460,707, filed Apr. 15, 1974, now U.S. Pat. No. 3,919,957 and entitled "Floating Structure and Method of Recovering Anchors Therefor" and includes the preferred relationship between the mooring lines pretension and the vessel displacement to obtain a minimum amount of surge of the platform. Other preferred relationships include the relationship between the anchor weight and anchor displacement, between anchor weight and platform displacement and between anchor displacement and platform displacement.

An object of the present invention is to provide an improved vertically moored floating platform which has a minimum of surge or sway motions responsive to periodic wave and wind loads.

Another object is to provide an improved vertically moored floating platform having optimum relationships for ease of moving the platforms and for stability of the platform when moored.

BRIEF DESCRIPTION OF THE DRAWINGS

These and other objects and advantages of the present invention are hereinafter more fully set forth and explained with respect to the drawings wherein.

DESCRIPTION OF THE PREFERRED EMBODIMENTS

Figure 1:
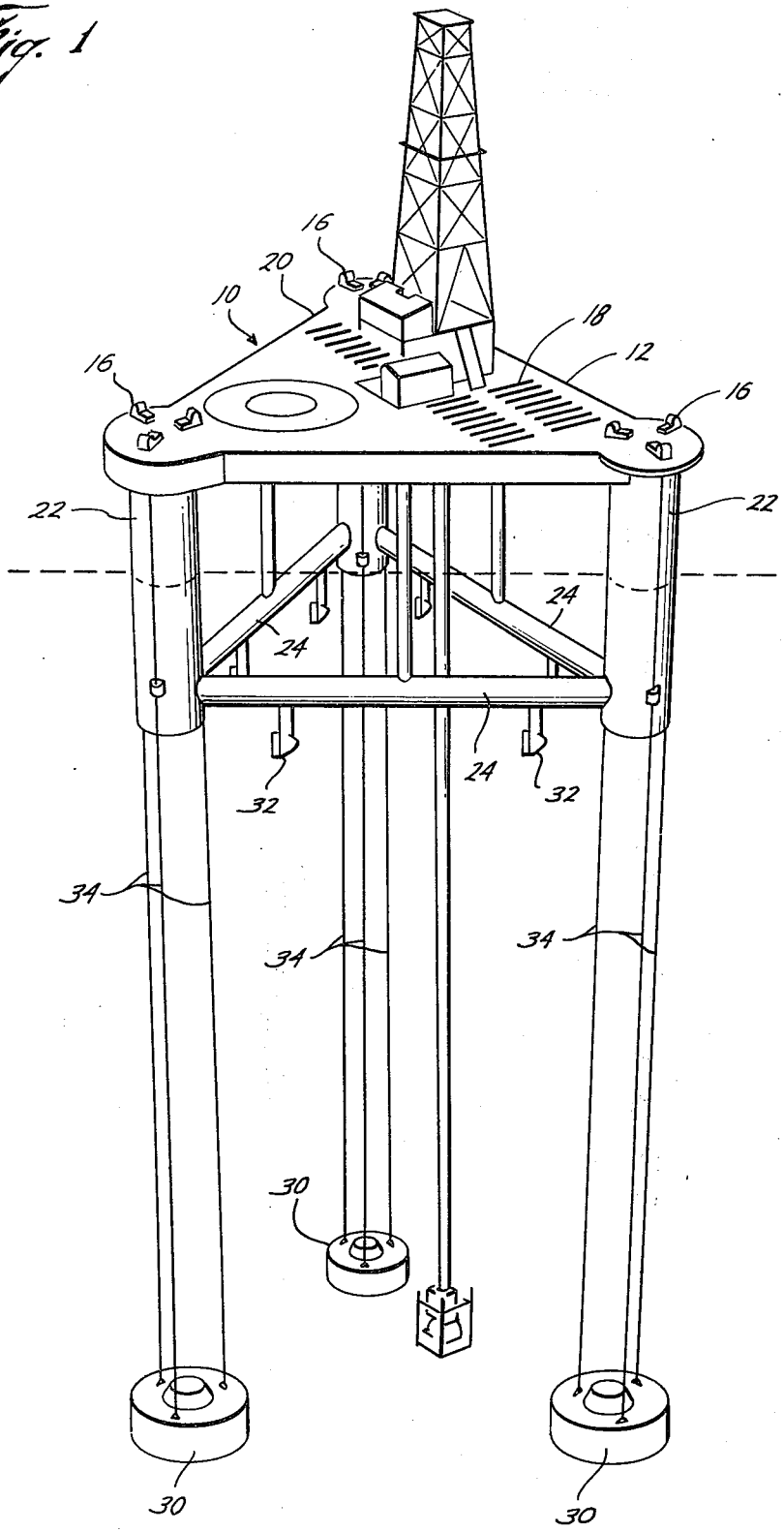
FIG. 1 is a perspective view of the floating structure moored at a drilling site with vertical, parallel mooring lines.

The floating structure 10 shown in FIG. 1 is shown to be a drilling platform but may be a production platform or any other moored floating structure. The floating structure 10 includes the deck 12 which is of generally triangular shape but may be of any suitable shape. The deck 12 supports the derrick 14, the winches 16, the pipe racks 18 and the housing 20. The legs 22 depend below the corners of the deck 12 and are connected near their lower ends by the horizontal members 24. This assembly of components is hereinafter referred to as the floating platform 28. In addition to the floating platform 28 the floating structure 10 also includes the anchors 30. The anchors 30 are the type of anchors shown in the aforementioned application Ser. No. 460,707 but any suitable anchor means may be used with the present invention. The thrusters 32 on the horizontal members 24 are used to assist in station keeping and moving.

Figure 3:
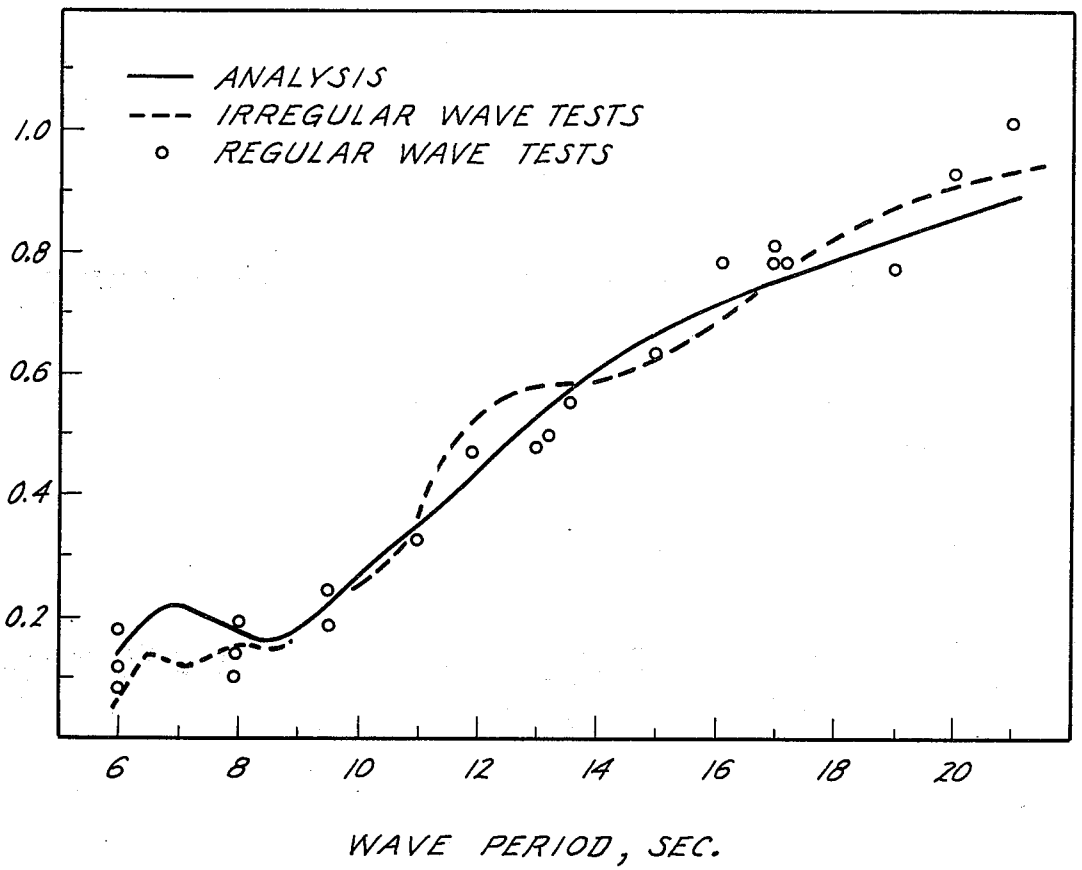
FIGS. 3, 4 and 5 are plots of a mathematical analysis and model tests with regular and irregular waves for 1,800, 2,200 kips of pretension with a single chain connection and 2,200 kips with a 3 chain connection to the bow column and each is a plot of the surge against the wave period.

With the present invention the floating structure 10 is moored from the anchors 30 by the plurality of parallel vertical mooring lines 34. When the anchors 30 are on the bottom as shown in FIG. 3 the connecting means 34 between the anchors 30 and the floating platform 28 are all maintained in tension to provide the tension mooring of the floating platform 28 as hereinafter explained. Such mooring lines 34 are connected to the upper end of the anchors 30 extending through the guides 46 and winches 16 and having their free ends stored in a chain compartment (not shown) within legs 22. If the anchors 30 are used rather than other type of anchor means such as a drilled in piling it is preferred that they include suitable ballasting and deballasting means (not shown).

The mooring of such structure is accomplished in any suitable manner such as ballasting the floating structure 10, securing the mooring lines by tightening with the winches 16 and with the lines taught and secure deballasting the floating platform until the mooring lines are loaded to the preselected tension as hereinafter explained.

In the design of vertically moored platforms as hereinbefore described the tension of the mooring lines between the anchors and the platform restrain the platform from heaving. However, such platform is free to surge or sway if excited by periodic external forces, such as wave and wind loads.

The magnitude of the tension in the mooring lines is selected between zero and the displacement of the platform. As the platform is subjected to wave action, the tension varies about the preselected static tension. Generally in the past it has been suggested that this preselected tension be of a value that the highest expected tension variations neither cause the tension in the restraining cables to drop to zero whereby the mooring lines become slack, nor to rise above the breaking strength of the mooring lines. However, as hereinafter developed, it may be seen that the level of this preselected tension affects the surge response of the vertically moored platform and by proper selection of the relationship of pretension to displacement a vertically moored platform may be designed to have minimum surge motions.

The platform by virtue of the tension on the mooring lines, is prevented from heaving responsive to wave action. However, it has been found that the increasing of pretensioning in the mooring lines while increasing the forces tending to return the platform to its stabilized position does not always reduce the surge or sway (the horizontal movement of the platform). In designing the platform for a minimum of surge, it is suggested that: (a) the preselected tension be from 0.05 to 0.30 times the displacement of the platform, (b) and if the platform has deployable anchors such as anchors 30 the ratio of the total anchor weight to their displacement be from 0.10 to 0.45, (c) the anchor weight be from 10 to 60% of the platform displacement and (d) the ratio of platform displacement to anchor displacement be in the range from 1.05 to 1.30. Such relationships have been developed empirically as hereinafter set forth and verified by model tests.

When wave or wind action displaces the platform from its neutral position the taut mooring lines providing a restoring force which tends to return the platform to its neutral position. This force is given by $$Fr = \frac{x}{L} T \qquad 1.$$

where x = platform offset from the neutral position
L = length of "tension-leg" or restraining lines
T = static or pretension in the restraining lines Rearranging $$Fr = \frac{T}{L} x \qquad 2.$$

or $$Fr = kx \qquad \ldots 3.$$

where $$k = \frac{T}{L}$$

We see that a vertically moored platform behaves in surge as a spring mass system with a spring constant given as T/L. From classical vibration theory we know the natural period of a spring mass system is $$Pn = \frac{2\pi}{k/m} \qquad 4.$$

where

Pn = natural period

For a vertically moored platform $$Pn = \frac{2\pi}{\frac{T}{Lm}} \qquad 5.$$

But the mass of the platform, the displacement of the platform and the pretension are related as follows:

$$mg = \nabla - T \qquad \ldots 6.$$

where $m$ = mass of the platform
$\nabla$ = displacement of the platform
T = pretension
$g$ = acceleration of gravity Let $\alpha$ be the ratio of the pretension to the platform displacement so that $$T = \alpha\nabla \qquad \ldots 7.$$

Substituting in the expression for the natural period $$Pn = \frac{2\pi}{\frac{\alpha}{T-\alpha} \frac{g}{L}} \qquad 8.$$

If the surge motions are to be kept low, the platform must not be operated near its natural period. Ocean waves have periods from about 3 seconds to 25 seconds. Since the platform should be functional in arbitrarily deep water, and since the natural period depends only upon $\alpha$ and L, the only way the natural period of the vertically moored platform can be adjusted is to vary $\alpha$, the ratio of pretension to displacement.

In order to establish how far the natural period of vertically moored platforms must be removed from that of ocean waves, additional principles from vibration theory will be considered. When a spring mass system with a natural period Pn is excited by some sinusoidal driving force with a period P, the steady state response of the system is described by $$xs = \frac{F}{k}(M) \sin \frac{2\pi}{Pn} t + \phi \qquad 9.$$

where

F = amplitude of the exciting force
$k$ = spring constant of the system
$t$ = time
$\phi$ = phase angle between the exciting force and the response
M = magnification factor and $$M = \frac{1}{(1-r^2)^2 + (2Lr)^2} \qquad 10.$$

where $$r = \frac{Pn}{P}$$

$\zeta$ = a damping factor

These equations can be simplified somewhat by assuming that the system is lightly dampted, that is $\zeta \approx 0$. In this case $$M = \frac{1}{1 - r^2} \qquad 11.$$

and $\phi = 0$ (or 180°)

We can now see that the amplitude of the steady state response is given by $$xa = \frac{F}{k}(M) \qquad 12.$$

or for the case of a vertically moored platform, the amplitude of the steady state surge is given by $$xa = F \frac{L}{\alpha\nabla} \frac{1}{\frac{Pn}{P}^2 - 1} \qquad 13.$$

where

F = amplitude of the horizontal force induced by wave action on the platform and substituting for Pn $$xa = \frac{F}{\nabla} \frac{1}{\frac{1-\alpha}{g}\left(\frac{2\pi}{P}\right)^2 - \frac{\alpha}{L}} \qquad 14.$$

$$xa = \frac{F}{\nabla} Am \qquad 15.$$

Thus the amplitude of the steady surge response of a vertically moored platform depends upon the displacement of the platform, the amplitude of the horizontal forces induced by wave action on the platform and on the surge amplification term, Am, which is a function of the ratio of the pretension to displacement, the period of the exciting waves, and the water depth. Since the amplitude of the wave induced horizontal force, F, and the displacement, $\nabla$, are established by the design of a particular platform, and since the platform will be placed in water of a known depth, L, the only remaining control the designer has over the surge (or sway) motions of the vessel is the ratio of pretension to the displacement of the vessel.

Figure 2:
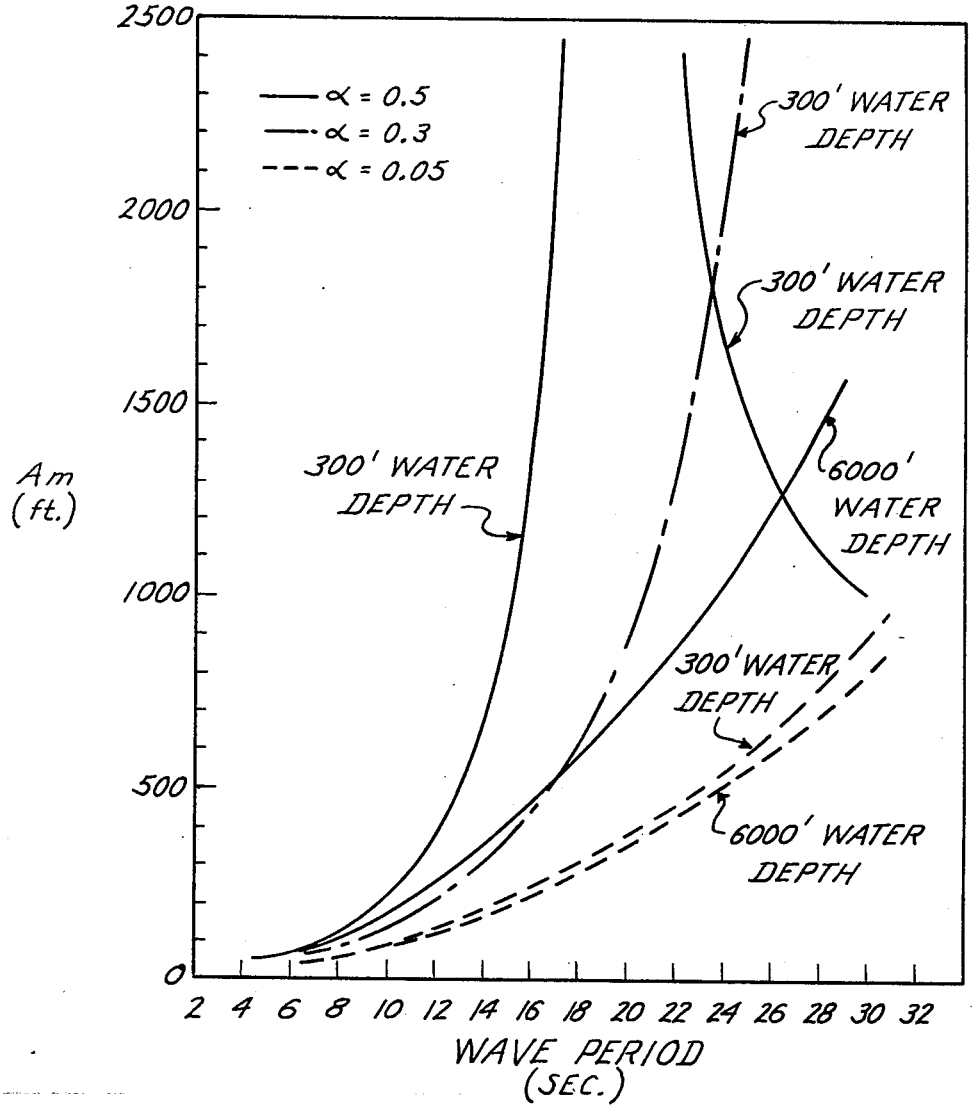
FIG. 2 is a plot of surge amplification function against wave period for water depths of 300 feet and 6,000 feet and ratios of pretension to anchor displacement of 0.5, 0.3 and 0.05.

FIG. 2 is a plot of the surge amplification Am in Equation (15) above against wave period and showing the effect of $\alpha$, the ratio of pretension to displacement and L, the water depth on the surge motion of a vertically moored platform. From such plot, it can see that the water depth has a smaller effect on surge motion than does the pretension-displacement ratio, especially in the greater water depths. Furthermore, the surge motions of a vertically moored platform in 300 feet of water with a pretension-displacement ratio of 0.5 would become unreasonably high if acted upon by waves with periods from 17 to 22 seconds. However, as the pretension-displacement ratio gets lower, we see that the value of this function gets lower and hence the surge motion is reduced. As shown above, increasing the tension in the restraining lines lowers the natural frequency and under certain circumstances can bring the natural frequency of a vertically moored platform within the range of ocean waves. This, of course, would result in large surge motions, an effect opposite that desired.

FIG. 17 also shows that a pretension-displacement ratio of 0.5 is too high for platforms moored in waters where the depth is near 300 feet. However, if the pretension-displacement ratio of a vertically moored platform moored in 300 foot deep water were about 0.3, it can be seen that the surge motions will remain bounded for all waves with periods less than 25 seconds.

It is therefore recommended that vertically moored platforms operated in some body of water where the wave periods range from about 3 to 25 seconds, should have pretension-displacement ratios between 0.05 and 0.3.

Other relationships may be developed from this tension displacement relationship for floating structures having deployable anchors. Since the pretension is equal to the platform displacement minus its weight, the quantity $\alpha$ from equation (7) is equal to the platform displacement minus the platform weight, divided by the displacement or $$\alpha = \frac{vm - Wp}{\nabla\ vm} \qquad 16.$$

measurements of the tension levels in vertical mooring lines during model tests of a vertically moored platform have shown that the tension varies symetrically about the pretension or still water value. So if a wave were to cause the tension level to drop from T to zero, the maximum tension which would be produced would be approximately 2T. In order to avoid anchor lifting the anchor weight must be at least 2T.

$$Wa \geqslant 2T \qquad \ldots 17$$

However, in the interest of efficient utilization of materials, a designer will probably not elect to make the weight of the anchor much greater than necessary or 2T. Therefore, if equation (7) is substituted into equation (17) there results $$Wa \simeq 2\alpha\ \nabla\ vm \qquad \ldots 18$$

From equation (18) we can establish from the preferred values of $\alpha$ that the preferred anchor weight is from ten to sixty percent of the platform displacement.

Since the anchors supply all the necessary flotation when the platform is in transit, their combined displacement equals the platform weight plus the anchor weight itself. Since the platform weight in transit is approximately its displacement when vertically moored less the pretension, we have $$\nabla a = \nabla vm - T + Wa \qquad \ldots 19$$

or substituting expressions (7) and (18) into (19) we find $$\nabla a \geqslant \nabla vm\ (1 + \alpha) \qquad \ldots 20.$$

or the combined displacement of the anchors should be greater than or equal the platform displacement times a factor of 1 plus $\alpha$. From equation (20) it can be seen that with the preferred values of $\alpha$ (0.05 to 0.30) the preferred ratio of anchor displacement to platform displacement is in the range from 1.05 to 1.30. Dividing (18) by (20) we obtain $$\frac{Wa}{Va} \geqslant \frac{2\alpha}{1+\alpha} \qquad 21.$$

The preferred range of values $\alpha$ to prevent the surge and sway motions of the platform from becoming excessive are in the range from 0.05 to 0.3. These values and the relations established above are used to establish the possible range of weights and displacements for the anchors. When substituted in equation (21) the ratio of anchor weight to anchor displacement falls in the range from 0.1 to 0.45.

Figure 4:
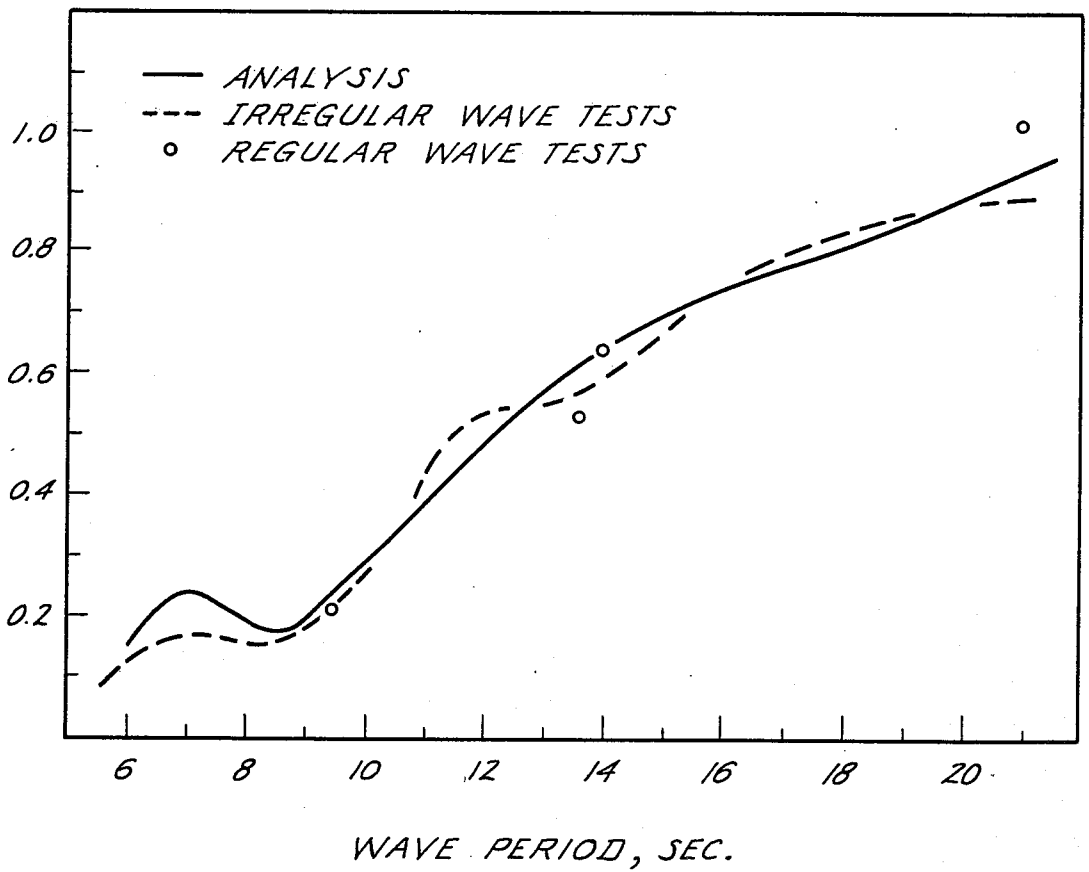
Figure 5:
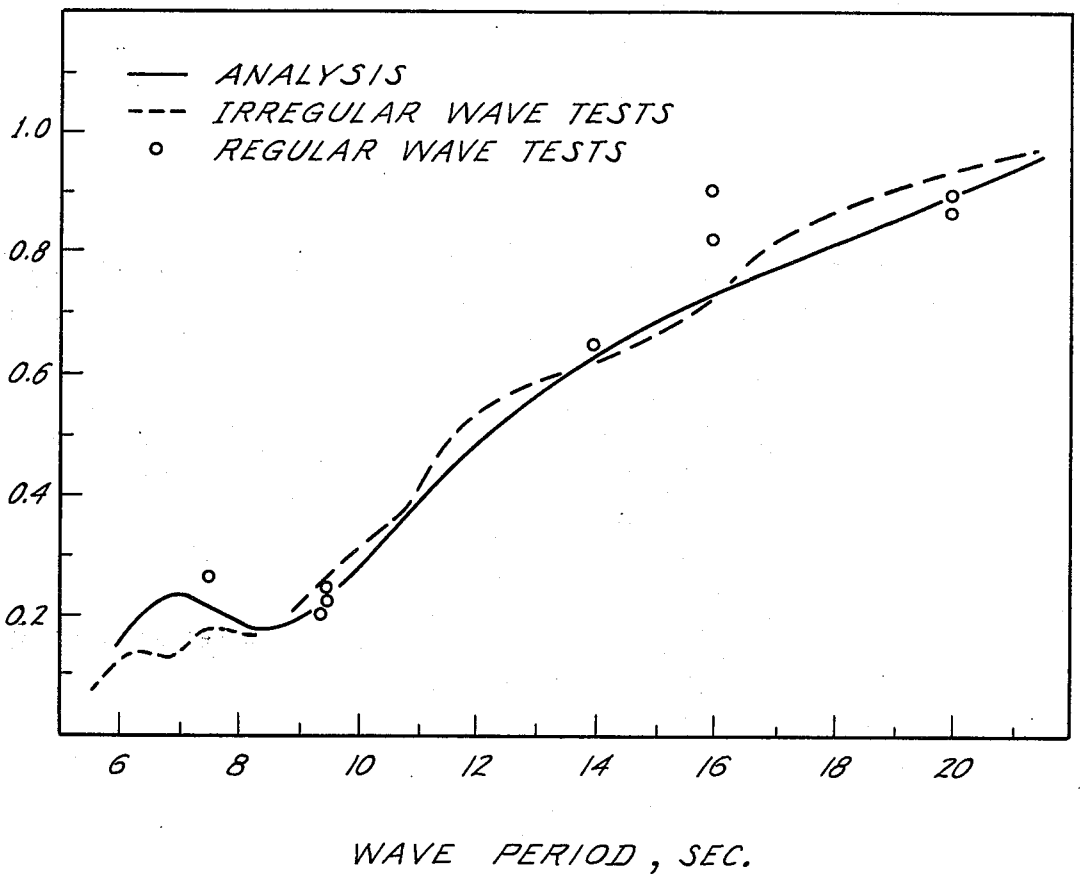

Since many assumptions were made in the above analysis (for example, the vertically moored platform behaves as a lightly damped system), it is desirable to compare the surge of an actual vertically moored platform with the values predicted by the above analysis. Two programs, one analytical, the other experimental, have been conducted which allow such a comparison to be made. As a result of the analytical study, mathematical equations which describe the wave induced horizontal forces acting on a vertically moored platform were developed. These equations were derived by applying standard principles from hydrodynamics and naval architecture to arrive at mathematical expressions describing the forces acting on each platform member. The complexity of the equations necessitated their solution be obtained by utilizing a digital computer. With these equations, it was possible to compute the horizontal forces produced by waves of arbitrary height and period acting on a particular platform, thereby providing a value for the quantity, F, in equation (15). Furthermore, a comprehensive series of model tests of a vertically moored platform has been completed. A triangularly shaped, vertically moored platform substantially shown in the drawings was subjected to both regular and irregular wave tests during which the surge motion of the platform was measured. The model was restrained by a single chain at each corner of the apex of the platform, except during one set of tests during which three chains were used on the bow column and one chain each on the other columns. Tests were conducted with the pretension in the restraining lines at two different levels. All of these results are shown in FIGS. 3, 4 and 5. These figures are plots of the surge operator (amplitude of the surge motion divided by wave height) vs. wave period. All results from the model tests were reported in prototype scale by applying a suitable scaling factor to the experimentally measured values; consequently, the experimental values shown on these figures are representative of a prototype platform. The solid lines on the plots represent values of the surge operator deduced from the theoretical analysis described above along with the equations developed in this disclosure. The dashed lines represent experimental results derived from a spectral analysis of the irregular wave tests. The solid dots represent experimental results from regular wave tests. The excellent agreement seen between the analytical and experimental results prove the assumptions made in deriving the equations in this disclosure are justified and that a prototype vertically moored platform has a surge response as hereinabove described.

What is claimed is:

1. A floating structure adapted for mooring in a preselected position comprising a platform having a reserve buoyancy, and a plurality of mooring lines adapted to be connected to and extending vertically below said platform in parallel relationship to each other in the body of water in which the platform is floating, said mooring lines being pretensioned so that the ratio of such pretension to the platform displacement falls in the range from 0.05 to 0.30.

2. A floating structure according to claim 1 including anchor means adapted to be secured to the lower end of said mooring lines.

3. A floating structure according to claim 2 wherein said anchor means includes anchors which have a weight to displacement ratio in the range from 0.10 to 0.45.

4. A floating structure according to claim 2 wherein said anchor means include anchors, and the ratio of weight of said anchors to the displacement of said platform is in the range from 0.10 to 0.60.

5. A floating structure according to claim 2 wherein said anchor means includes anchors, and the ratio of the displacement of said anchors to the displacement of said platform is in the range from 1.05 to 1.30.

6. A floating structure according to claim 2 wherein said anchor means includes anchors, and said anchors have a weight to displacement ratio in the range from 0.10 to 0.45, the ratio of weight of said anchors to the displacement of said platform is in the range from 0.10 to 0.60; and the ratio of the displacement of said anchors to the displacement of said platform is in the range from 1.05 to 1.30.

* * * * *

UNITED STATES PATENT OFFICE
CERTIFICATE OF CORRECTION

Patent No. 3,982,492 Dated Sept. 28, 1976

Inventor(s) Riddle E. Steddum

It is certified that error appears in the above-identified patent and that said Letters Patent are hereby corrected as shown below:

Column 1, line 59, corrected to read as follows:

-- structure 10 includes the deck 12 which is of a generally --.

Column 3, lines 2 and 3, corrected to read as follows:

-- from its neutral position the taut mooring lines provide a restoring force which tends to return the platform --.

Column 3, formula 4, corrected to read as follows:

$$P_n = \frac{2\pi}{\sqrt{K/m}} \quad \ldots\ldots 4$$

Column 3, formula 5, corrected to read as follows:

$$P_n = \frac{2\pi}{\sqrt{\frac{T}{Lm}}} \quad \ldots\ldots 5$$

UNITED STATES PATENT OFFICE
CERTIFICATE OF CORRECTION

Patent No. 3,982,492 Dated Sept. 28, 1976

Inventor(s) Riddle E. Steddum

It is certified that error appears in the above-identified patent and that said Letters Patent are hereby corrected as shown below:

Column 3, formula 8, corrected to read as follows:

$$P_n = \frac{2\pi}{\sqrt{\left(\frac{\alpha}{1-\alpha}\right)\frac{g}{L}}} \qquad \ldots 8$$

Column 4, formula 9, corrected to read as follows:

$$x_s = \frac{F}{K}(M)\sin\left(\frac{2\pi}{P_n}t + \phi\right) \qquad \ldots 9$$

Column 4, formula 10, corrected to read as follows:

$$M = \frac{1}{\sqrt{(1-r^2)^2 + (2\zeta r)^2}} \qquad \ldots 10$$

UNITED STATES PATENT OFFICE
CERTIFICATE OF CORRECTION

Patent No. 3,982,492 Dated Sept. 28, 1976

Inventor(s) Riddle E. Steddum

It is certified that error appears in the above-identified patent and that said Letters Patent are hereby corrected as shown below:

Column 4, line 36, delete "dampted" and insert -- damped -- and after the "0" insert a period at the end of the line; line 37, delete the period at the beginning of the line.

Column 4, formula 11, corrected to read as follows:

$$M = \frac{1}{|1 - r^2|} \quad \ldots\ldots 11$$

Column 4, formula 12, corrected to read as follows:

$$x_a = \frac{F}{k}(M) \quad \ldots 12$$

Column 4, formula 13, corrected to read as follows:

$$x_a = F \frac{L}{\alpha \nabla} \frac{1}{\left(\frac{P_n}{P}\right)^2 - 1} \quad \ldots\ldots 13$$

UNITED STATES PATENT OFFICE

CERTIFICATE OF CORRECTION

Patent No. 3,982,492 Dated Sept. 28, 1976

Inventor(s) Riddle E. Steddum

It is certified that error appears in the above-identified patent and that said Letters Patent are hereby corrected as shown below:

$$x_a = \frac{F}{\nabla} A_m \qquad \ldots 15$$

Column 5, lines 34, corrected to read as follows:

-- FIG. 2 also shows that a pretension-displacement --.

Column 5, formula 16, corrected to read as follows:

$$\alpha = \frac{V_{vm} - W_p}{\nabla_{vm}} \qquad \ldots 16$$

UNITED STATES PATENT OFFICE
CERTIFICATE OF CORRECTION

Patent No. 3,982,492 Dated Sept. 28, 1976

Inventor(s) Riddle E. Steddum

It is certified that error appears in the above-identified patent and that said Letters Patent are hereby corrected as shown below:

Column 6, formula 19, corrected to read as follows:

$$\nabla_a = \nabla_{vm} - T + W_a \quad \ldots 19$$

Column 6, formula 20, corrected to read as follows:

$$\nabla_a \geq \nabla_{vm} (1 + \alpha) \quad \ldots 20$$

UNITED STATES PATENT OFFICE
CERTIFICATE OF CORRECTION

Patent No. 3,982,492 Dated September 28, 1976

Inventor(s) Riddle E. Steddum

It is certified that error appears in the above-identified patent and that said Letters Patent are hereby corrected as shown below:

Column 6, formula 21, corrected to read as follows:

$$\frac{W_a}{V_a} \geqq \frac{2\alpha}{1+\alpha} \qquad \ldots 21$$

Signed and Sealed this

Thirty-first Day of May 1977

[SEAL]

*Attest:*

RUTH C. MASON
*Attesting Officer*

C. MARSHALL DANN
*Commissioner of Patents and Trademarks*